US006269944B1

(12) United States Patent
Taylor

(10) Patent No.: US 6,269,944 B1
(45) Date of Patent: Aug. 7, 2001

(54) CHANNELED BEAM EXTRUDED OF ALUMINUM ALLOY FOR CRANE OR CONVEYOR

(75) Inventor: Michael K. Taylor, Marion, NY (US)

(73) Assignee: Gorbel, Inc., Fishers, NY (US)

( * ) Notice: Subject to any disclaimer, the term of this patent is extended or adjusted under 35 U.S.C. 154(b) by 0 days.

(21) Appl. No.: 09/239,868

(22) Filed: Jan. 29, 1999

(51) Int. Cl.[7] ..... B66C 23/70

(52) U.S. Cl. ..... 198/860.2; 198/685; 104/94; 104/108; 212/177; 212/225

(58) Field of Search ..... 198/678.1, 685–687, 198/860.1, 860.2; 104/94, 106–109; 212/225–228, 177

(56) References Cited

U.S. PATENT DOCUMENTS 3,687,367 * 8/1972 Schurch et al. ..... 104/106
3,855,937 * 12/1974 Cuadill ..... 104/106
3,987,877 * 10/1976 Bulanchuk ..... 104/108
4,576,096 * 3/1986 Toder ..... 104/94
4,768,442 * 9/1988 Miller ..... 104/94
5,443,151 * 8/1995 Taylor ..... 198/678.1
5,598,784 * 2/1997 Kubisk et al. ..... 198/836.4

OTHER PUBLICATIONS

Specification Sheet from Zimmerman International Corp. titled "Cross Section, ZRA2 Strong Back Rail, Part No.: 30000T", Madison Heights, MI, 1994, one sheet.

* cited by examiner

*Primary Examiner*—Christopher P. Ellis
*Assistant Examiner*—Mark A. Deuble
(74) *Attorney, Agent, or Firm*—Eugene Stephens & Associates

(57) ABSTRACT

A beam extruded of aluminum alloy for use in cranes and conveyors is formed with a channel having runs that straddle an open bottom and are strengthened by pin receivers formed in C-shapes with material integrally extruded under the runs. An upper region of the channel is formed with upright parallel fins that serve as a mounting element. T-shaped strengthening upper beam elements can be secured to the channel by sliding them between the parallel fins where they are held in place by fasteners. The upright fins also accommodate a variety of mounting arrangements.

17 Claims, 6 Drawing Sheets

CHANNELED BEAM EXTRUDED OF ALUMINUM ALLOY FOR CRANE OR CONVEYOR

TECHNICAL FIELD

Extruded aluminum alloy beams for bridge cranes and conveyors.

BACKGROUND

Co-assigned U.S. Pat. No. 5,443,151 suggests a serviceable configuration for a beam extruded of an aluminum alloy for use in cranes and conveyors. At least one other configuration of extruded aluminum beams for such purposes also exists. Extruded aluminum offers several advantages over steel, especially if the extrusion profile has an optimum configuration. This invention advances the art of aluminum alloy beam extrusions beyond the suggestions of the '151 patent.

This invention aims at reducing the expense of extruded aluminum alloy beams while making such beams more readily varied and versatile. Versatility is advanced by accommodating several different mounting systems and providing a wide range of beam strengths from a minimum of extruded components. Improved economy occurs from reducing the size and weight of extruded parts and optimizing the use of metal in extrusion profiles.

SUMMARY OF THE INVENTION

A channel portion of an extruded aluminum crane beam is formed separately from any strengthening upper portion that may be required. This allows a channel to be used independently or combined with upper portions varying in strength to produce a range of load-bearing capacities.

The channel portion of the beam is provided with pin receivers that are formed under runs that support wheeled elements on opposite sides of an open bottom of the channel. The pin receivers are formed to add metal under the runs for strengthening purposes, while also providing the convenience of receiving dowel pins that align butt-jointed beam sections.

An upper wall of the channel is formed with a pair of upstanding fins that can receive mounting elements and T-shaped upper strengthening members. Any of these can be secured to the channel by fasteners extending through the upstanding fins. This arrangement makes a variety of different beam installations convenient and facilitates combining channels with upper members of different strengths.

Economies arise from reducing the overall size and weight of extruded components. Versatility results from the ease and convenience of combining different mounts and strengthening upper members with the mounting element formed on the channel.

DRAWINGS

FIGS. 3, 5, 7, and 9 are partially schematic, fragmentary elevational views of mounting variations for extruded beams; and FIGS. 4, 6, 8, and 10 are end views respectively of the beams of FIGS. 3, 5, 7, and 9.

DETAILED DESCRIPTION

Figure 1:
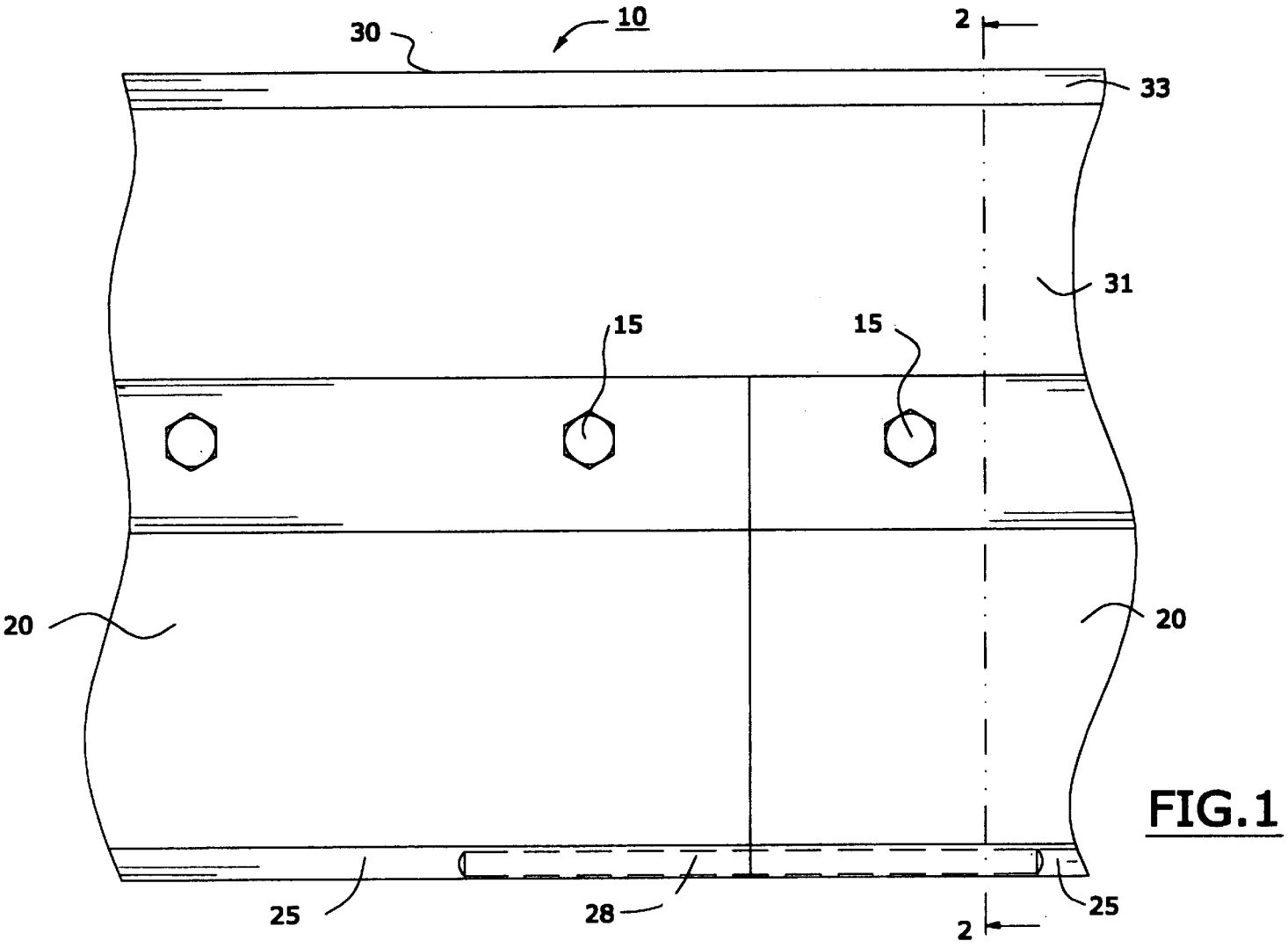
FIG. 1 is a partially schematic, fragmentary elevational view of a preferred embodiment of an extruded beam including a strengthening upper element.
Figure 2:
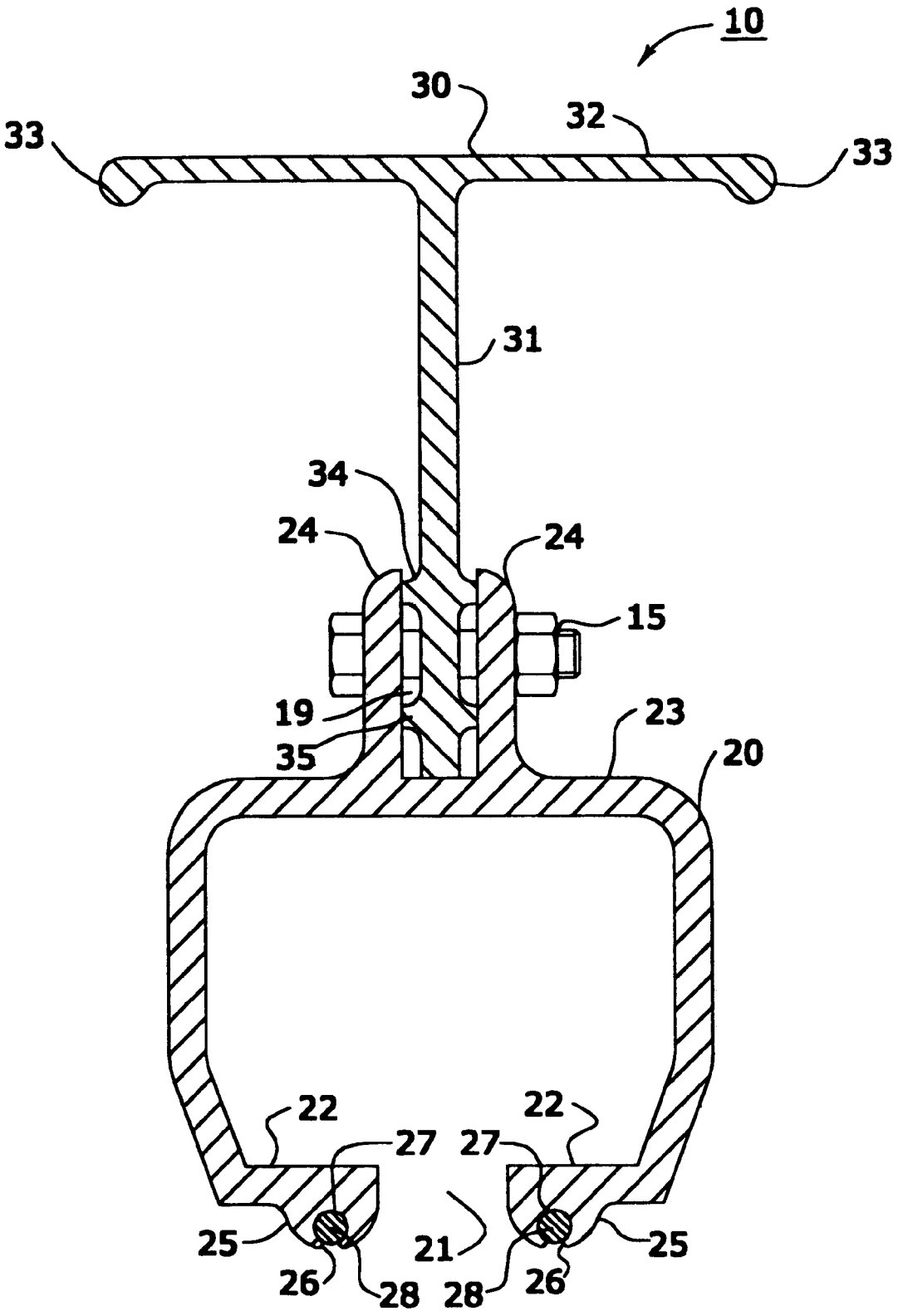
FIG. 2 is a cross-sectional view of the beam of FIG. 1, taken along the line 2—2 thereof.

A preferred embodiment of an extruded alloy beam 10 for a crane or conveyor is shown in FIGS. 1 and 2 as formed of an extruded channel 20 and a separately extruded strengthening upper element 30 having a T-shape. Both channel 20 and upper T-element 30 can be formed with different dimensions and thicknesses of material to provide different load-bearing strengths. Channel 20 can also be used independently of upper element 30 wherever channel 20 offers sufficient strength by itself. The combinability of channels 20 with strengthening elements 30 increases the variety of load-bearing strengths obtainable from a few extrusion profiles. Extruding channel 20 separately from T-element 30 economizes by reducing the die circle required and the extruded weight involved. This reduces the expense and complexity of the extrusion machinery and keeps down the cost of components so that the variety of assembled beams obtainable is also relatively inexpensive.

Channel 20 has an open bottom 21 straddled by a pair of runs 22 that support a wheeled element (not shown) for rolling along within channel 20. The load-bearing strength of runs 22 is increased by forming a dowel pin receiver 25 under each run 22. Each dowel pin receiver 25 has a slot 26 that opens downward, and the interior of each dowel pin receiver 25 has a cylindrical surface 27 that extends for more than 180 degrees to receive and hold an end-wise inserted dowel pin 28. Dowel pins 28, when inserted into receivers 25 of butt-jointed channels 20, as shown in FIG. 1, ensure accurate alignment of runs 22.

At an upper region of channel 20, a top wall 23 is formed with a pair of upstanding and parallel fins 24 serving as a mounting element. A space 19 between fins 24 can receive a strengthening or mounting element connected to channel 20 by fasteners 15, such as the illustrated bolts. Forming fins 24 as upstanding and parallel facilitates a variety of such attachments, as explained below.

T-shaped strengthening element 30 includes a web 31 that extends downward from a T-32 that preferably has enlarged end regions 33 for added strength. A lower region of web 31 is formed to fit into the space 19 between mounting fins 24, for connection to channel 20. Different configurations can accomplish this; and a preferred shape, as illustrated in FIG. 2, includes a pair of laterally enlarged or laterally extending regions 34 and 35 that have a sliding fit between fins 24. Fasteners such as rivets or bolts 15 can then secure strengthening element 30 to channel 20. Assembly of T-top 30 and channel 20 is facilitated by simply sliding the two components together, drilling the necessary holes, and applying fasteners 15.

Channel 20 can be used by itself, without the strengthening addition of T-element 30, wherever channel 20 is able to independently carry the required load. When strengthening upper element 30 is combined with channel 20, it can extend for a full length or a portion of a full length of channel 20. Upper element 30 can also have different heights, thicknesses, and strengths to give channel 20 different load-bearing abilities.

Figure 4:
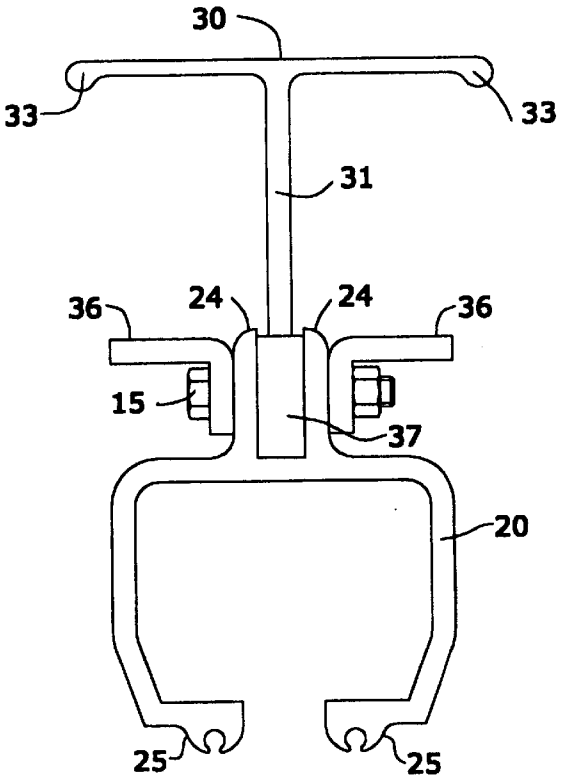
Figure 3:
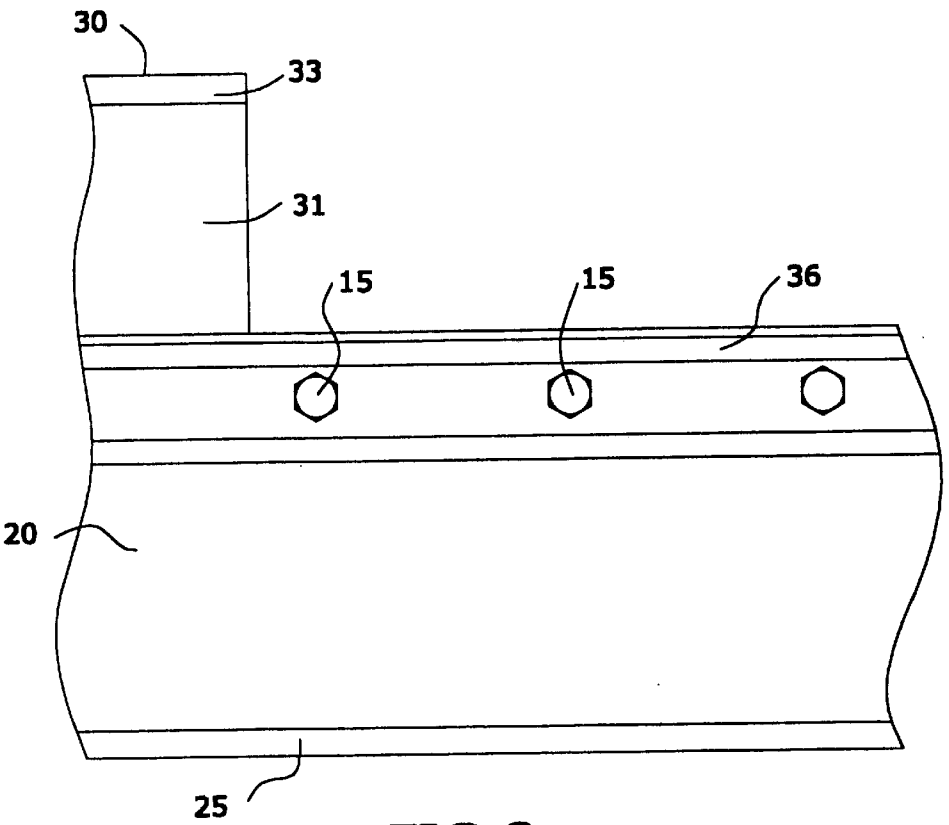

A few of the many ways that crane and conveyor beams can be mounted with the preferred embodiments are illustrated in FIGS. 3–10. FIGS. 3 and 4 show a coped beam assembly in which an upper strengthening element 30 terminates short of the end regions of a channel 20. The end regions of channel 20 can then be mounted on a support structure by means of angle irons 36 or other connectors secured to mounting element fins 24 by fasteners 15. A spacer or shim 37 is preferably inserted between fins 24 in end regions not occupied by T-element 30 to support fins 24 against the tension applied by fasteners 15.

Figure 6:
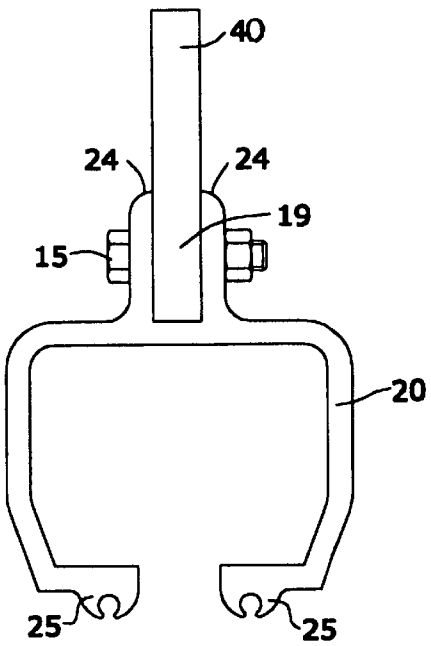
Figure 5:
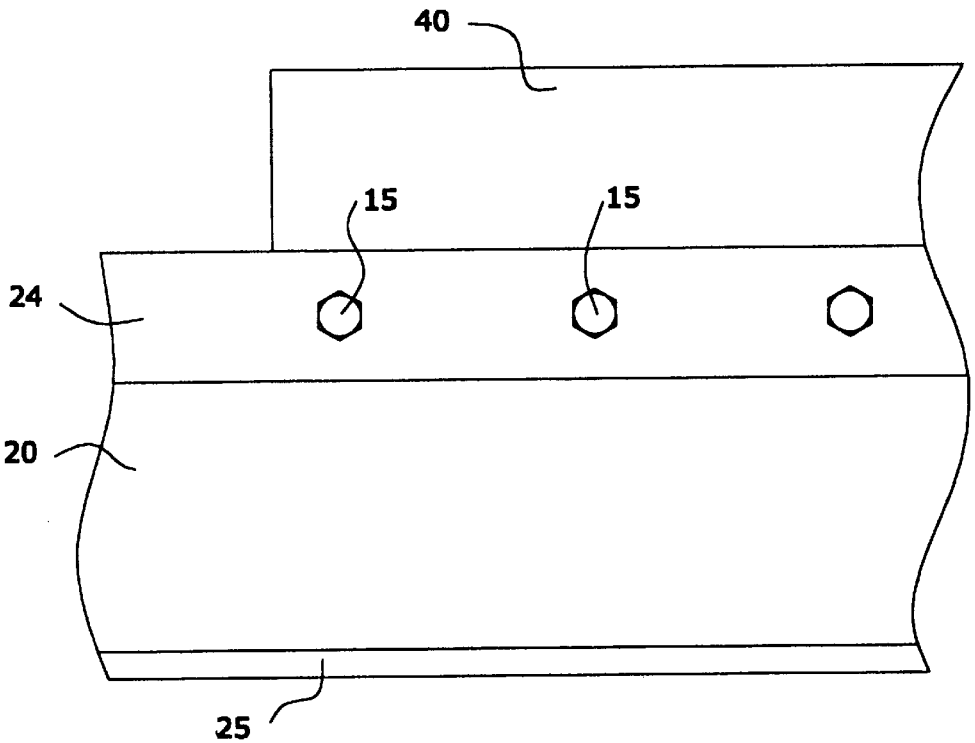

The embodiment of FIGS. 5 and 6 illustrates the possibility of a simple mounting plate 40 for an end region of channel 20. Plate 40 is arranged between fins 24 and secured by fasteners 15 to extend above channel 20 for mounting purposes. If plate 40 does not have a thickness that matches the space 19 between fins 24, then-shims can be added as necessary. Plate 40 can be used with or without an upper T-element 30 secured to a portion of channel 20.

Figure 8:
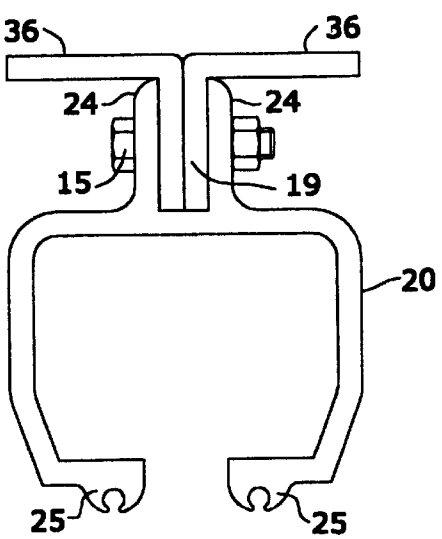
Figure 7:
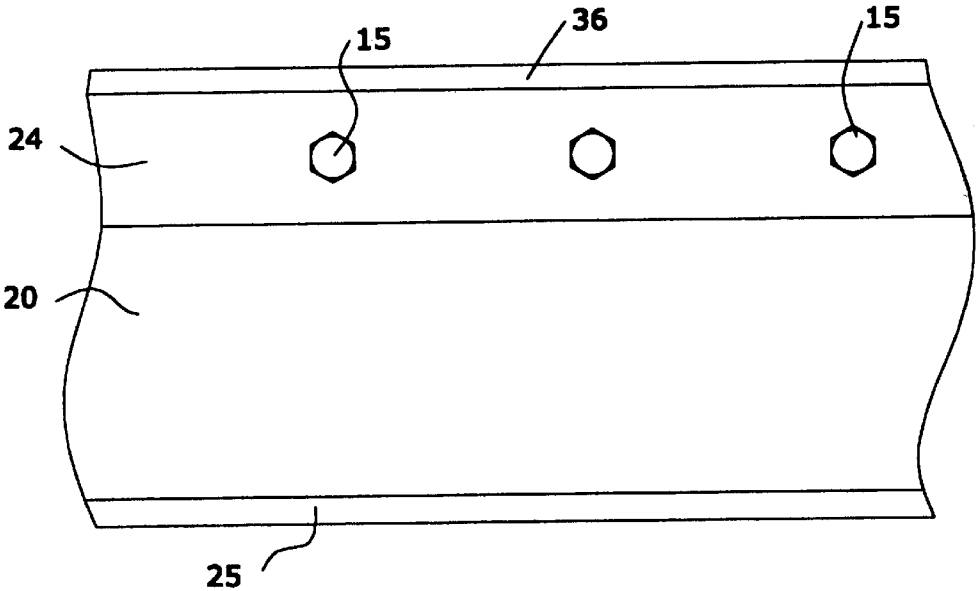

The embodiment of FIGS. 7 and 8 shows another way that angle irons 36 can be used for mounting a channel 20. As shown in FIG. 8, angle irons 36 can be disposed back to back within the space 19 between upright parallel fins 24, where the angle irons can be secured by fasteners 15. If angle irons 36 do not completely fill space 19, a shim can be added.

Figure 10:
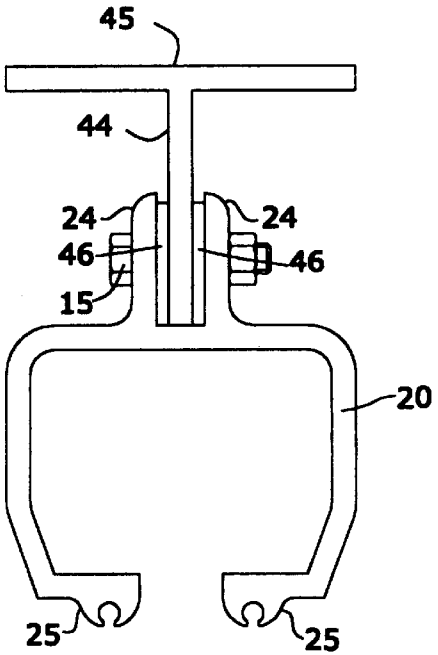
Figure 9:
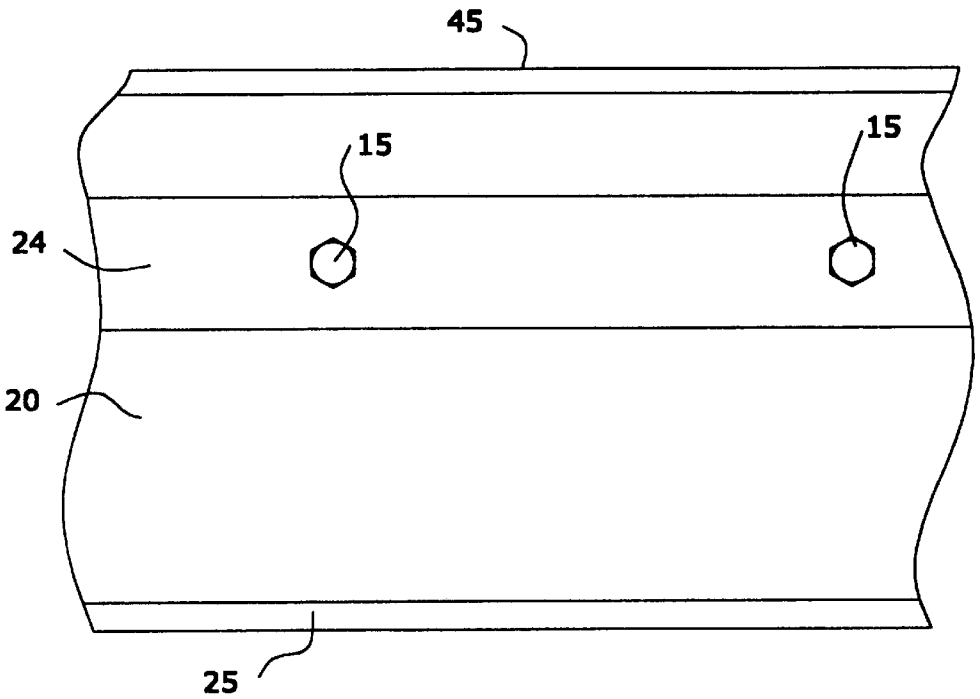

The embodiment of FIGS. 9 and 10 illustrates the possibility of a conventional T-hanger 45 arranged to support a channel 20. A lower region of an upright web 44 of T-hanger 45 is inserted between parallel mounting fins 24 with shims 46 added as necessary to fill the space between fins 24. Fasteners 15 then secure T-hanger 45 to channel 20 for mounting.

The mounting arrangements of FIGS. 3–10 are not exhaustive. They illustrate some of the variety that is possible using channel 20, which can be strengthened by adding T-element 30.

I claim:

1. A unitary crane or conveyor channel beam integrally extruded of an aluminum alloy to form a channel with an open bottom straddled by runs that support a wheeled element for rolling along the runs within the channel, the beam comprising:

a. a bottom of the channel having an integrally extruded pin receiver configured to retain a pin inserted therein formed underneath each run on each side of the bottom opening, the position of the pin receivers under the runs and the extruded material provided under the runs configuring the pin receivers serving to thicken a substantial portion of the runs and strengthen the load-bearing ability of the runs;

b. a pair of upstanding and parallel fins integrally extruded on a top wall of the channel above the open bottom to form a mounting element; and c. an extruded unitary strengthening element having a vertically extending web secured to the mounting element between the upstanding fins.

2. The beam of claim 1 wherein a lower region of the web has opposed lateral regions dimensioned to fit between the upstanding fins of the mounting element.

3. The beam of claim 1 including fasteners extending through the web and the mounting element at intervals along the beam.

4. The beam of claim 1 wherein the pin receivers open downward.

5. The beam of claim 1 including a beam mounting structure secured to the mounting element with fasteners extending through the fins.

6. A unitary crane or conveyor channel beam integrally extruded of an aluminum alloy to form an open bottom straddled by runs that support a wheeled element running in a channel, the beam comprising:

a. the runs being strengthened in load-bearing ability by having an integrally extruded C-shaped structure added below the underside of each run to serve as a dowel pin receiver;

b. the dowel pin receivers being formed with cylindrical recesses having cylindrical surfaces extending for more than 180 degrees to receive and hold end-wise inserted dowel pins that align the runs at a beam butt joint;

c. a top of the channel having an integrally extruded mounting element; and d. an extruded unitary strengthening element having a vertical web secured to the mounting element.

7. The beam of claim 6 wherein the mounting element comprises an upstanding fin.

8. The beam of claim 7 wherein the mounting element comprises a pair of upstanding and parallel fins.

9. The beam of claim 6 including fasteners extending through the mounting element and the vertical web at intervals along the length of the beam.

10. The beam of claim 6 including a configuration formed on a lower region of the vertical web to fit the strengthening element to the mounting element.

11. The beam of claim 10 wherein the mounting element comprises a pair of upstanding and parallel fins straddling the configuration of the lower region of the vertical web.

12. The beam of claim 6 wherein the dowel pin receivers are downwardly open.

13. A crane or conveyor beam formed of a pair of unitary aluminum alloy extrusions comprising:

a. a first extrusion forming a channel having an integrally extruded mounting element formed as a pair of upstanding and parallel fins on a top wall of the channel;

b. a second extrusion forming a T-shape with a vertical web having a lower region fitted between the parallel fins and secured to the mounting element with fasteners; and c. wheel runs on opposite sides of an open bottom of the channel being strengthened by an integrally extruded C-shaped structure added underneath each run and serving as a dowel pin receiver.

14. The beam of claim 13 wherein the lower region of the web is configured with a pair of lateral enlargements that fit between the fins.

15. The beam of claim 13 wherein the fasteners extend through the web and the mounting element at intervals along the beam.

16. The beam of claim 13 wherein the C-shaped structures open downwardly.

17. The beam of claim 13 wherein the C-shaped structures have cylindrical surfaces that extend more than 180 degrees and receive end-wise inserted dowel pins.

* * * * *